US012108877B2

(12) United States Patent
Hjellegjerde

(10) Patent No.: US 12,108,877 B2
(45) Date of Patent: Oct. 8, 2024

(54) SEATING DEVICE WITH A RECLINING FUNCTION

(71) Applicant: H2 NORWAY AS, Alesund (NO)

(72) Inventor: Nils Gunnar Hjellegjerde, Sykkylven (NO)

(73) Assignee: H2 NORWAY AS, Alesund (NO)

( * ) Notice: Subject to any disclaimer, the term of this patent is extended or adjusted under 35 U.S.C. 154(b) by 98 days.

(21) Appl. No.: 17/921,560

(22) PCT Filed: Apr. 28, 2021

(86) PCT No.: PCT/NO2021/050107

§ 371 (c)(1),
(2) Date: Oct. 26, 2022

(87) PCT Pub. No.: WO2021/221515

PCT Pub. Date: Nov. 4, 2021

(65) Prior Publication Data

US 2023/0157452 A1 May 25, 2023

(30) Foreign Application Priority Data

Apr. 28, 2020 (NO) ..... 20200502

(51) Int. Cl.

| | |
|---|---|
| ***A47C 7/30*** | (2006.01) |
| ***A47C 1/024*** | (2006.01) |
| ***A47C 7/44*** | (2006.01) |
| ***A47C 7/46*** | (2006.01) |

(52) U.S. Cl.

CPC ..... *A47C 1/024* (2013.01); *A47C 7/30* (2013.01); *A47C 7/44* (2013.01); *A47C 7/46* (2013.01)

(58) Field of Classification Search

CPC ..... A47C 7/30; A47C 7/46
USPC ..... 297/452.52, 452.53
See application file for complete search history.

(56) References Cited

U.S. PATENT DOCUMENTS

| | | | | |
|---|---|---|---|---|
| 2,835,312 A | | 5/1958 | Neely | |
| 3,241,879 A | * | 3/1966 | Castello | B60N 2/7047 297/452.52 |
| 3,550,926 A | * | 12/1970 | Slominski | A47C 7/46 267/107 |

(Continued)

FOREIGN PATENT DOCUMENTS

| | | | | |
|---|---|---|---|---|
| DE | 848407 C | * | 9/1952 | A47C 7/30 |
| FR | 1218371 A | * | 5/1960 | A47C 7/30 |

(Continued)

OTHER PUBLICATIONS

International Search Report and Written Opinion mailed in corresponding PCT/No. 2021/050107 on Aug. 25, 2021 (8 pages).

(Continued)

*Primary Examiner* — Rodney B White
(74) *Attorney, Agent, or Firm* — Wissing Miller LLP

(57) ABSTRACT

A seating device (1) with a reclining function comprising a back frame (4) which provides a significant reduction in the complexity of the system, at the same time as it gives the user increased comfort both in an upright (sitting) position and in a reclining position. The back frame (4) comprises in particular two types of resilient elements (7, 8) and rotatable fasteners (6) which provide adaptive support to the lumbar spine in both a sitting and reclining position.

7 Claims, 4 Drawing Sheets

(56) References Cited

U.S. PATENT DOCUMENTS 4,159,847 A * 7/1979 Arai ..... B60N 2/667 297/284.4
4,247,089 A * 1/1981 Crosby ..... A47C 7/30 5/247
4,283,046 A * 8/1981 Bowles, Jr. ..... A47C 7/025 297/452.52
4,296,965 A * 10/1981 Sakurada ..... A47C 7/462 297/284.4
4,371,153 A * 2/1983 Krakauer ..... A47C 7/30 267/105
4,565,406 A * 1/1986 Suzuki ..... A47C 7/462 297/284.4
4,586,700 A * 5/1986 Crosby ..... A47C 7/30 5/255
4,715,587 A * 12/1987 Grosby ..... A47C 7/30 267/110
4,815,717 A * 3/1989 Crosby ..... A47C 7/30 297/452.52 X
5,499,863 A * 3/1996 Nakane ..... B60N 2/682 297/452.2
5,538,325 A * 7/1996 Bullard ..... A47C 7/30 297/440.22
5,651,584 A * 7/1997 Chenot ..... B60N 2/667 297/284.4
6,565,157 B2 * 5/2003 Barile, Jr. ..... A47C 7/282 297/452.52
6,637,824 B1 * 10/2003 Yokota ..... B60N 2/72 297/452.52
7,090,301 B2 * 8/2006 Stadlbauer ..... A47C 7/46 297/452.52
8,991,016 B2 * 3/2015 Conway ..... F16B 15/0015 206/338
9,420,897 B2 * 8/2016 Conway ..... F16B 15/06
9,771,009 B2 * 9/2017 Kijima ..... B60N 2/72
2004/0245841 A1 12/2004 Beukema
2009/0015050 A1 * 1/2009 Dehli ..... A47C 1/03283 297/340
2009/0250991 A1 10/2009 Mossbeck
2015/0013118 A1 * 1/2015 Conway ..... A47C 31/06 24/347

FOREIGN PATENT DOCUMENTS

FR 1307745 A * 10/1965 ..... A47C 7/30
FR 1417751 A * 11/1965 ..... A47C 7/30
GB 649649 A * 1/1951 ..... A47C 7/30
WO 2009061204 5/2009

OTHER PUBLICATIONS

Norwegian Search Report mailed in corresponding No. 20200502 on Jun. 24, 2022 (2 pages).

* cited by examiner

SEATING DEVICE WITH A RECLINING FUNCTION

CROSS-REFERENCE TO RELATED APPLICATIONS

This application is a 371 of PCT/NO2021/050107 filed on Apr. 28, 2021, published on Nov. 4, 2021 under publication number WO 2021/221515 A1, which claims priority benefits from Norwegian patent application Ser. No. 20/200,502 filed Apr. 28, 2020, the disclosure of each is incorporated herein in their entirety by reference.

TECHNICAL FIELD

The present invention relates to a seating device with a reclining function.

BACKGROUND

About 80 percent of adults experience low back pain at some point in their lives. It is the most common cause of work-related disability and a leading contributor to lost work days. It is therefore important that it is easy for everyone to find a good sitting position with a satisfactory backrest.

Since recliners/sofas with movable backs came on the market, there has been a challenge with too much/too little lumbar support and that the lumbar support in the chair moves in relation to the anatomy of the user's spine when the chair back is laid back (the chair opens).

When sitting in the chair/sofa with the backrest in a more or less upright position, a user will find it comfortable that the backrest is shaped according to the anatomy of the user's spine, i.e. with a small sway and extra support against the lower back. The extra lumbar support is also ergonomically correct when being in a sitting position.

The challenge comes when the back is lowered to a resting position. Depending on how many degrees the chair/sofa mechanism allows, the lumbar support will no longer be as comfortable. It simply feels too hard and has "moved" upwards and will hit the user on the upper side of the lower back. How much depends on the anatomy of the chair and the movement pattern of the mechanism. In a more supine sitting position, the need for lumbar support is less and a more "flat" support surface is more ergonomically correct.

Throughout the ages, this has been attempted solved through a lot of trial and error as well as several patents. Common to them all is that they have almost no effect, or may not achieve the desired effect, at the same time these mechanisms are often complicated. There is still a need for a simple and effective solution to these problems.

SUMMARY OF THE INVENTION

It is an object of the present invention to provide a sitting device which avoids the above-mentioned problems with previously known devices and further provides an adapted support for the lumbar spine both in a sitting and reclining, resting or lying position.

The above-mentioned objects of the invention are achieved with a device as stated in the following patent claims.

The scope of the invention is defined in the following claims.

More particularly, the invention comprises a reclining function seating device comprising a seat, a back element and a rotatable hinge member.

The invention also comprises a back frame for use in a sitting device with a reclining function.

BRIEF DESCRIPTION OF THE DRAWINGS

The invention will now be described in detail with reference to the accompanying drawings, in which.

Further features and advantages of the invention will become apparent from the following detailed description.

DETAILED DESCRIPTION OF THE INVENTION

Figure 1:
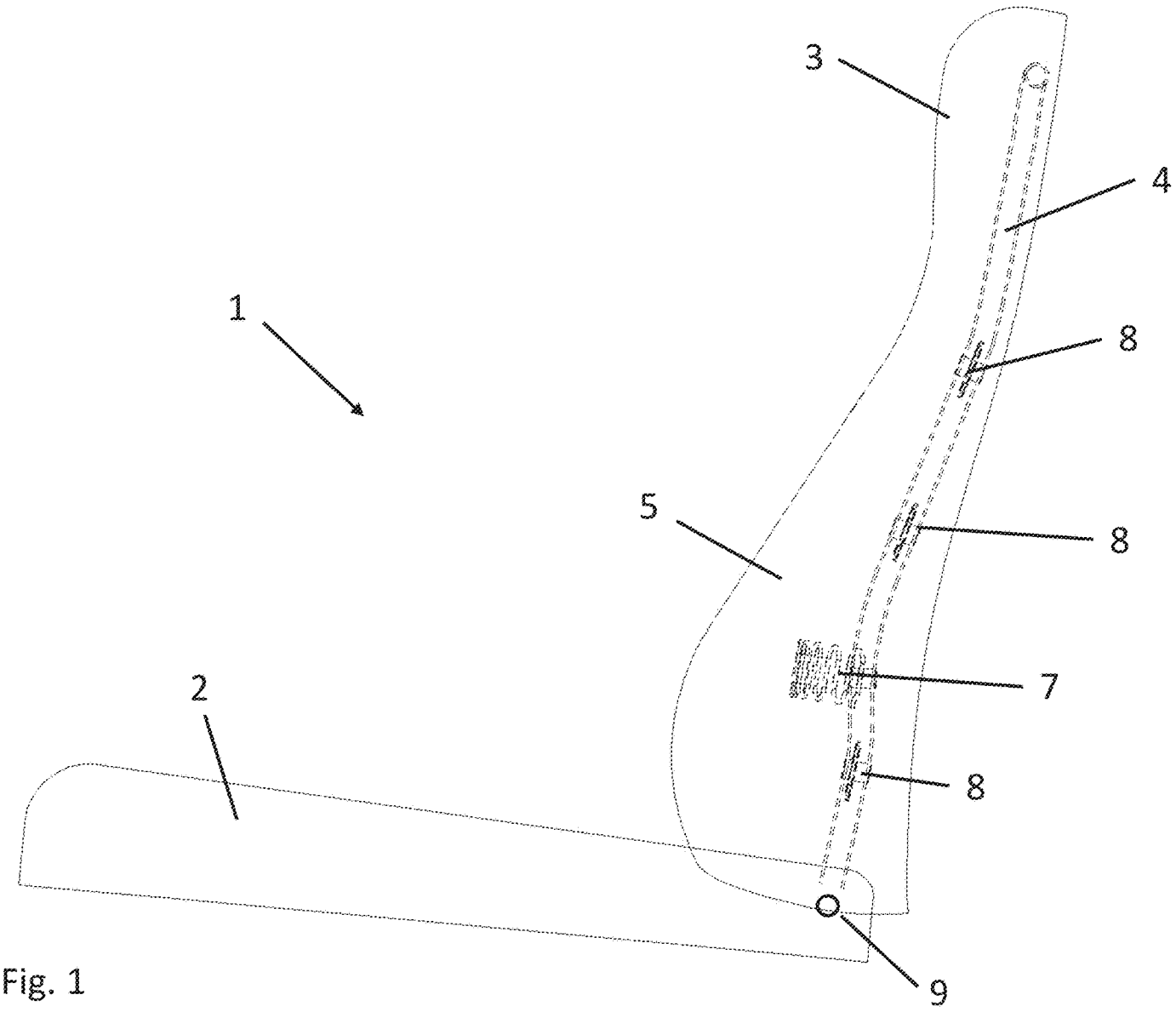
FIG. 1 is a sketch of the chair seen from a side with an upright backrest.

FIG. 1 shows a seating device 1 according to the invention with an upright backrest. The seating device 1 can be a chair, a sofa, a car seat, or the like. The seating device 1 comprises a seat 2, a backrest element 3 and a rotatable hinge element 9 which allows reclining function.

The backrest element 3 comprises a back frame 4 and padding 5, for example in foam, where the padding 5 is arranged on one or both sides of the frame.

Figure 2:
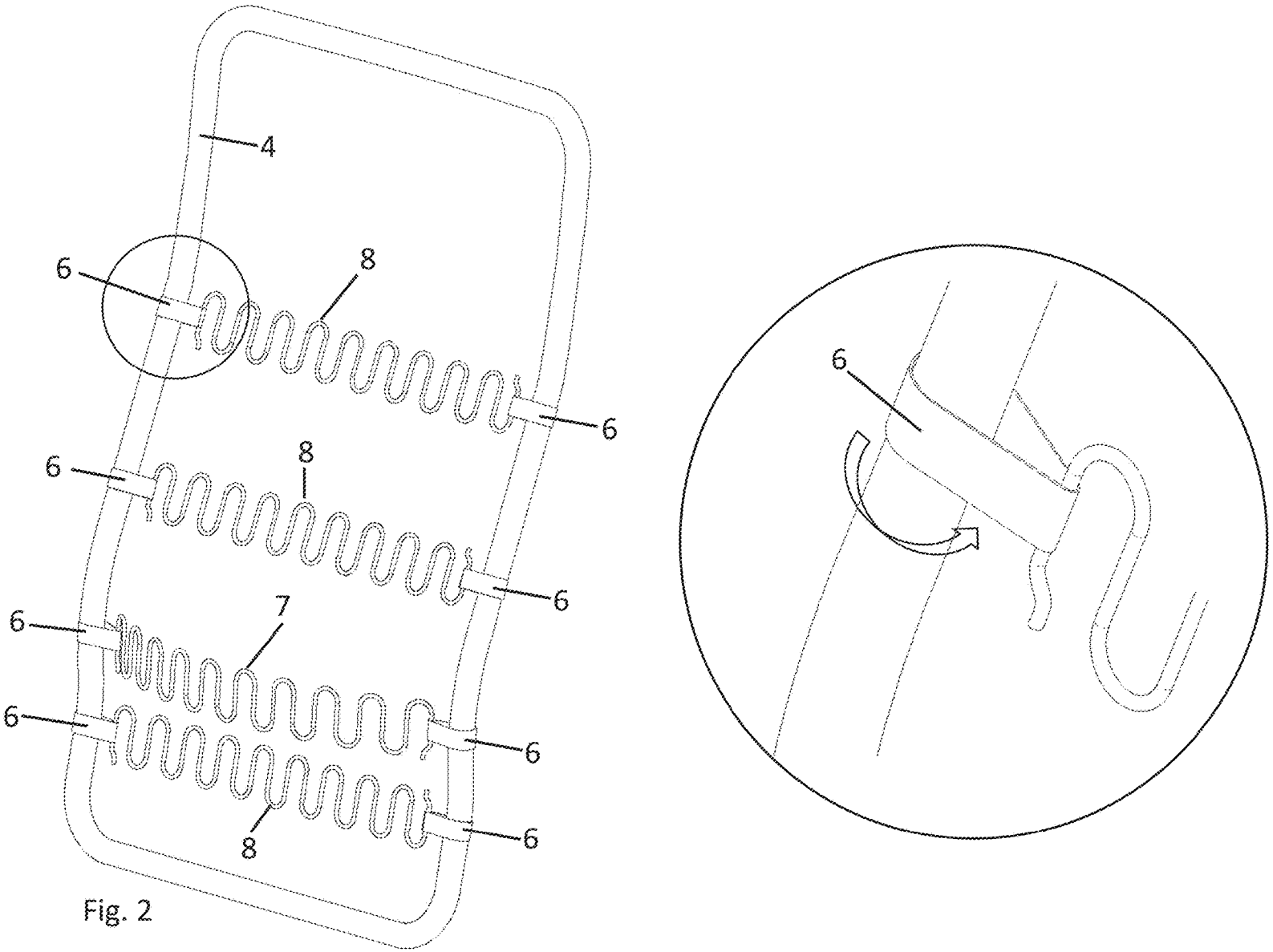
FIG. 2 is a sketch of the back frame seen from the front.

FIG. 2 shows the structure of the back frame 4 as well as a detailed sketch of a rotatable fastener 6, where the arrow shows how the rotatable fasteners 6 are rotated.

The back frame 4, which is formed as a forward-shaped part, comprises at least one first resilient element 7 and one or more second resilient elements 8. The first resilient elements 7 are made of a material which is suitable for being made with prestress (bias) and which can withstand deformation during use, for example high carbon steel wire, molded plastic, rubber, curved steel strip, fiber casting, etc., preferably high carbon steel wire. The second resilient elements 8 are made of a material suitable for having a supporting or resilient effect, for example steel strip, plastic plate, textile webbing, fabric, rubber mat, high carbon steel wire, molded plastic, rubber, curved steel strip, fiber casting, etc. In case the resilient elements 7, 8 are made of steel wire, they may follow a zigzag pattern. The resilient elements 7 and 8 are independently bonded to the frame preferably at each end, either directly or via fasteners 6, preferably via rotatable fasteners. The fasteners 6 can be made of, for example, plastic, metal, leather, fabric or fiber.

In one embodiment, the elements 7, 8 are resilient and arcuate before mounting. The first resilient (yielding) element 7 follows a curve which has a smaller radius compared to the radius of the one or more other resilient elements 8. The first resilient element 7 is longer than the one or more other resilient elements 8. Mounting of these elements 7, 8 on the frame 4 gives them a prestress.

The first resilient element 7 has a carefully determined prestress, matched firmness and fastening. The one or more other elements 8 are located above and below the first element 7 and are considerably firmer and flatter. Distance (position) and matched firmness are based on the ergonomics of the spine and how much the back "moves" in relation to the user's lumbar support and the effect of the user's weight on the yielding element. The chairs will be manufactured in different sizes and hardness adapted to the individual customer as well as markets in e.g. Europe and Asia.

When the user is sitting in an upright position as shown in FIG. 1, the forward-shaped or convex first resilient element 7 in the central back will largely retain the prestress (and create the desired lumbar support). The weight of the user sitting in the chair will largely decrease towards the seat 2. The pressure/weight exerted against the backrest element 3 is therefore limited in this position and the desired lumbar support is maintained.

Figure 3:
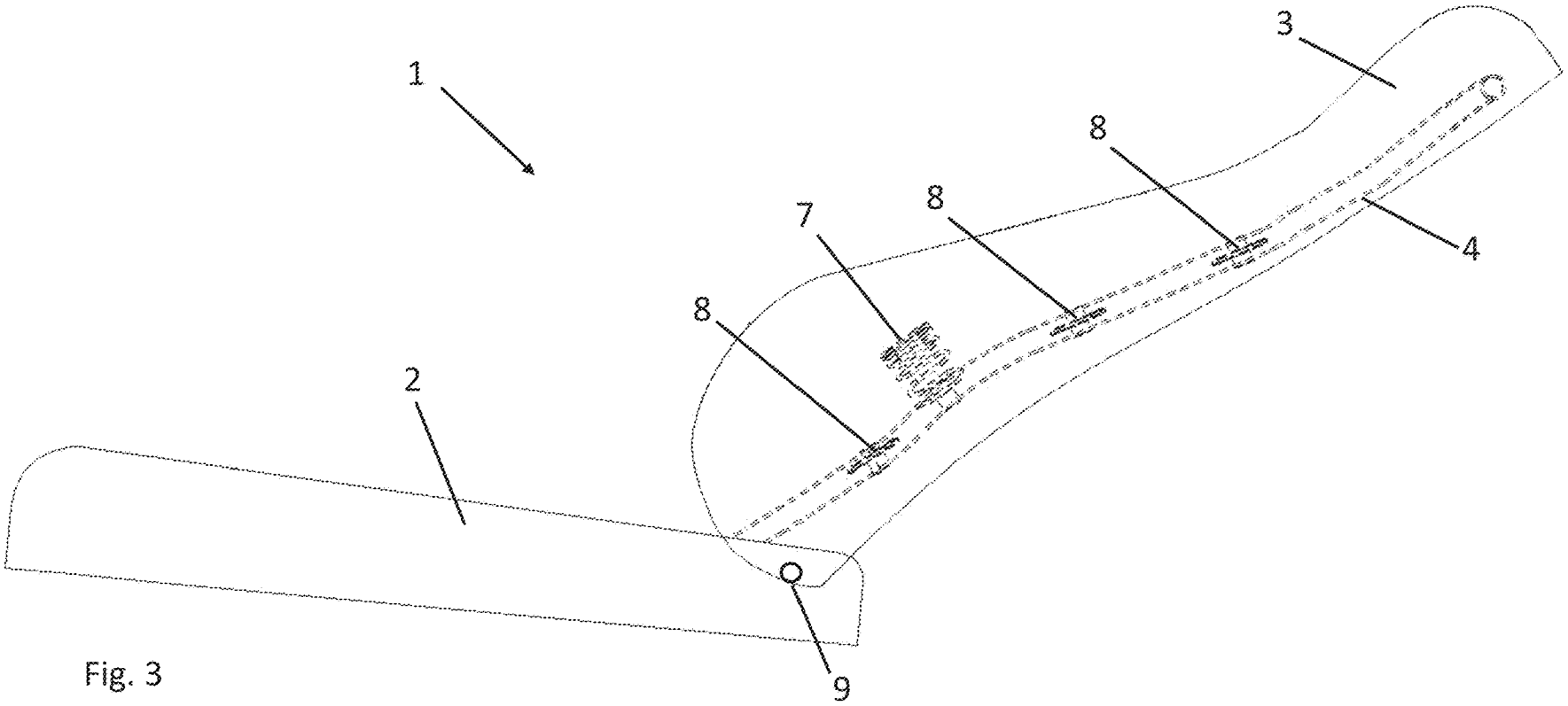
FIG. 3 is a sketch of the chair with a reclining backrest without load seen from one side.
Figure 4:
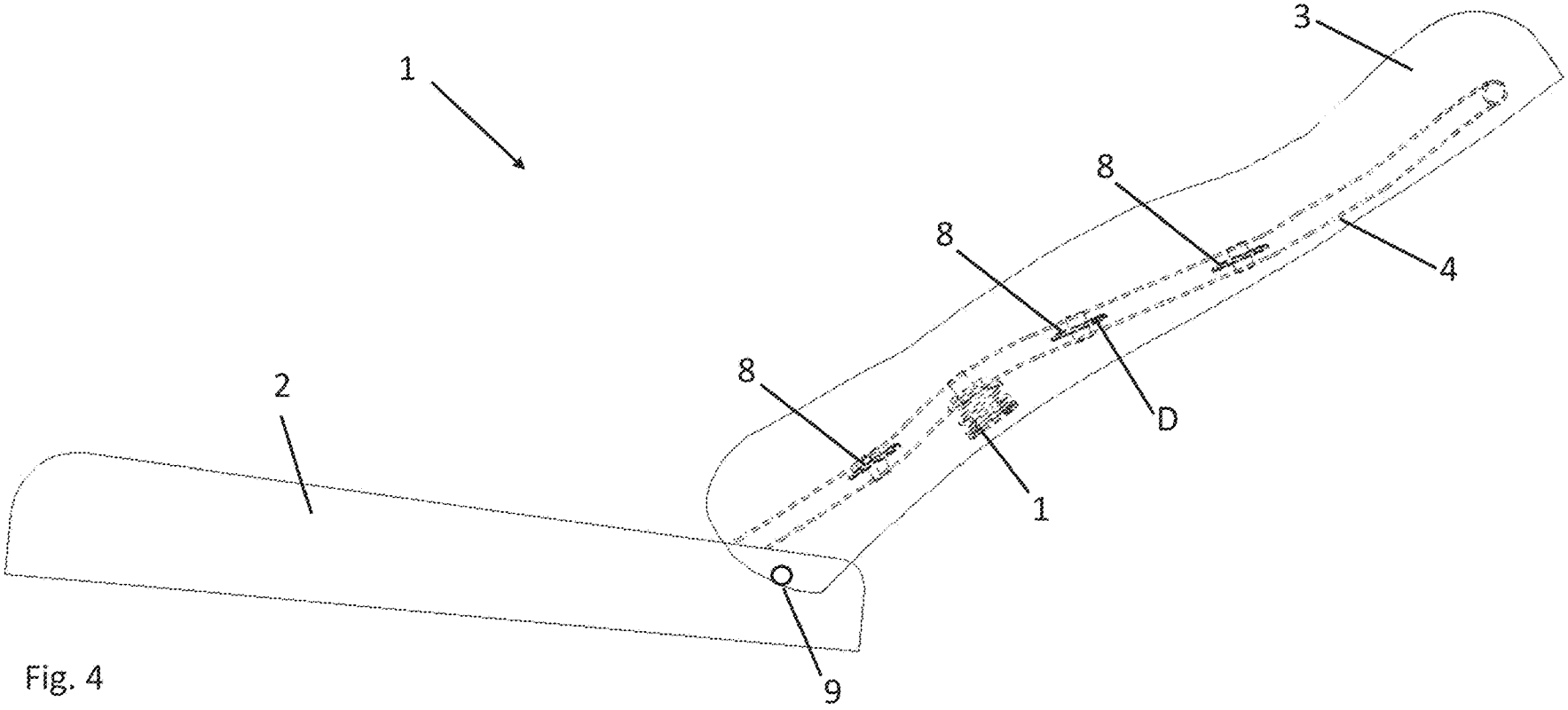
FIG. 4 is a sketch of the chair with a reclining backrest under load seen from one side.

FIG. 3 shows the seating device 1 with a reclining backrest element 3 without load. FIG. 4 shows the seating device 1 with a reclining backrest element 3 with load.

When the backrest element 3 of the seating device 1 is placed backwards, the user lying (sitting) in the chair will distribute the weight on both the seat 2 and the backrest element 3, in relation to the upright position as shown in FIG. 1. The backrest element will thereby receive a significant greater weight against it. The padding 5 in the backrest element 3 is then compressed and deformed (flattened out). The first resilient element 7 now yields and acquires a more backward-bent or even concave shape.

The fasteners 6 will, due to their rotatability, reinforce this movement from the back frame. The back frame can be forward-striving, for example so that it follows the natural curvature of the user's back.

The padding 5 in the backrest element 3 is so soft that it yields to the extent that the weight exerted against the first resilient element 7 straightens and bends it backwards, but not so soft that the other elements 8 feel uncomfortable for the user.

The other elements 8 will stretch a little, but are less affected by these forces as they are harder, tighter and yield less compared to the first resilient element 7.

The other elements 8, on the other hand, must have a carefully positioned and coordinated firmness in order to "take over" the support of the first "yielding" element 7.

All the resilient elements 7, 8 must be mounted in a coordinated relationship with each other and the design of the back frame 4.

The total effect is that the padding 5 in the back element 3 becomes flatter in the supine position and the relative lumbar support is moved downwards because the other resilient elements 8 become more prominent than the first resilient element 7 in the supine position. On a normal chair/sofa, the area for lumbar support on the back of the chair that meets the spine will move upwards when the backrest element 3 is laid down (the chair opens). On the described seating device 1, the back frame 4 will become more prominent in the supine position and a more correct position, pressure and position of the lumbar support in relation to the anatomy of the spine of the user is maintained.

The invention claimed is:

1. A seating device with reclining function comprising a seat, a backrest element and a rotatable hinge element which connects the seat to the backrest element, wherein the backrest element comprises padding and a back frame including at least one first resilient element arranged between one or more second resilient elements, wherein each resilient element is bonded to the back frame via fasteners at each end thereof, the at least one first resilient element being curved convexly towards a back of a user when the seating device is in the sitting position, and the at least one first resilient element being arranged to assume a curved concave shape against the user's back when the seating device is in a reclined/loaded position, and wherein the at least one first resilient element is longer than the one or more second resilient elements, and the one or more second resilient elements are stiffer and less resilient than the at least one first resilient element.

2. A back frame for use in a sitting device with reclining function, wherein the back frame comprises at least one first resilient element arranged between one or more second resilient elements, wherein each resilient element is bonded to the back frame via fasteners at each end thereof, the at least one first resilient element being curved convexly towards a back of a user when the seating device is in the sitting position, and wherein the at least one first resilient element is arranged so that it assumes a curved concave shape against the user's back when the seating device is in the reclined/loaded position, and wherein the at least one first resilient element is longer than the one or more second resilient elements, and the one or more second resilient elements are stiffer and less resilient than the at least one first resilient element.

3. The seating device according to claim 1 or the back frame according to claim 2, wherein the first and second resilient elements are made of high-carbon steel wire.

4. The seating device or the back frame according to claim 3, wherein the high-carbon steel wire follows a zigzag pattern.

5. The seating device according to claim 1 or the back frame according to claim 2, wherein the fasteners are rotatable fasteners.

6. The seating device or the back frame according to claim 5, wherein the first and second resilient elements are arcuate, the at least one first resilient element being designed so as to follow a curve with a shorter radius than the one or more second resilient elements.

7. The seating device or the back frame according to claim 6, wherein the at least one first resilient element and the one or more second resilient elements are mounted with prestress in the back frame.

* * * * *